United States Patent [19]

Strange et al.

[11] 4,112,986

[45] Sep. 12, 1978

[54] AUTOMATIC DADOING MACHINE

[75] Inventors: Delbert D. Strange; Ronald M. Hunts, both of San Diego, Calif.

[73] Assignee: Manufacturing Approaches & Total Concepts, Inc., San Diego, Calif.

[21] Appl. No.: 728,405

[22] Filed: Sep. 30, 1976

Related U.S. Application Data

[62] Division of Ser. No. 600,726, Jul. 31, 1975, Pat. No. 4,005,738.

[51] Int. Cl.[2] ..... B27C 5/02

[52] U.S. Cl. ..... 144/323; 144/136 R; 144/133 R; 83/5; 144/309 A; 83/368

[58] Field of Search ..... 144/136 R, 133 R, 323, 144/309 R, 309 A; 83/5, 368

[56] References Cited

U.S. PATENT DOCUMENTS

| | | | |
|---|---|---|---|
| 3,672,415 | 6/1972 | Holan | 144/136 R |
| 3,719,114 | 3/1973 | Vischulis | 83/368 |
| 3,741,060 | 6/1973 | Owen | 83/368 |
| 3,770,031 | 11/1973 | Olson | 144/136 R |

*Primary Examiner*—Donald R. Schran
*Attorney, Agent, or Firm*—Cahill, Sutton & Thomas

[57] ABSTRACT

Method and apparatus are disclosed for dadoing cabinet panels. The dados are cut by a plurality of routers selectively extended into the panel. The selection of the number of routers, translatory movement of each of the routers, and positioning of the panel is controlled by air operated mechanisms. A pneumatic control system processes the operation of the routers in response to the inputs from a plurality of manually settable controls and the signals developed by feed back mechanisms.

4 Claims, 21 Drawing Figures

AUTOMATIC DADOING MACHINE sp

This is a division of application Ser. No. 600,726 filed 7/31/75 now U.S. Pat. No. 4,005,738.

The present invention relates to dado machines and, more particularly, to automated dado machines having pneumatically programmed control systems.

With the increasing labor costs in all areas of manufacture, continuing development of machinery to replace skilled labor has been diligently pursued in most areas of manufacture. One such area which has received little attention until the last few years is that of the woodworking art. As a consequence, aside from the variously developed manually operated tools, little work has been done to develop and perfect woodworking machinery which automatically performs woodworking functions. Moreover, because of the nature of the products presently produced of wood or wood related materials, many pieces are one of a kind or of very low volume demand. Both of these factors necessarily preclude effective use of mass production techniques.

In the field of cabinet making, the shelves are often supported by a shelf seat extending internal to the cabinet from the sides of the cabinet. The internally extending seats are, in inexpensive cabinets, normally strips of wood glued and nailed to the cabinet side at the appropriate height. The more expensive selectively positionable metallic flanges seating within a vertically oriented strip with a plurality of receiving apertures is generally reserved for cabinets or bookshelves requiring an adjustable shelf height capability. The nailed and glued supports are generally used for limited production run cabinetry or wherein uniformity is not of paramount importance. The adjustable supports are generally used within special purpose cabinetry which warrants an increased cost factor.

In more expensive cabinets which do not need to have height adjustable shelves, a channel or dado is cut into opposed internal sides of the cabinet to receivingly support the ends of the shelves. Channeling, or dadoing of the cabinet sides necessitates substantial skilled labor costs and capital expenditure for equipment and is warranted only by a large production run or high priced cabinets.

For historic reasons, the woodworking art has been relatively slow with respect to the development of equipment for mass production purposes. That is, manually operated tools have been developed but relatively few automated mechanisms for accomplishing a plurality of woodworking functions are generally available. With respect to the forming or cutting of channels within a board of wood or a board having wood-like qualities, two avenues have been explored. First, rotary wheels have been utilized for cutting slots or grooves. U.S. Pat. Nos.: 2,864,414, 2,907,359, 2,951,517, 3,036,605, 3,538,968 and 3,651,842 are representative of such equipment. Second, routers and router-like cutting implements have been employed. U.S. Pat. Nos.: 2,988,119, 3,003,527, 3,060,981, 3,602,276, 3,627,001, 3,735,787 and 3,770,031 are representative of such machinery.

Despite the variations in equipment and design of the machines described in the above identified patents, either or both of two serious drawbacks persist. First, the work piece is transported with respect to the cutting element; or, second, the work piece remains stationary but some manual effort must be expended in order to cut a channel or dado into the work piece. If the work piece is to be moved, ancillary work piece receiving/discharging stations must be employed which necessitates further equipment or manual labor; the machine must incorporate some type of gripping means for transporting the work piece past the cutting element and such gripping means has a tendency to mar or deface the work piece. In those machines where the cutting element is manually operated, highly skilled and expensive labor must be employed; moreover, the need for manual guiding necessarily precludes absolute uniformity of channeled work pieces during a long production run.

It is therefore a primary object of the present invention to provide a pre-programmable automated dadoing machine.

Another object of the present invention is to provide a pneumatically operated control system for an automated dadoing machine.

Yet another object of the present invention is to provide a dadoing machine for repetitively making a predetermined plurality of dados of pre-programmed length, width and depth in work pieces.

A further object of the present invention is to provide a control system for a dadoing machine which includes settable parameters for the type and number of dados to be made within each of a plurality of work pieces.

A yet further object of the present invention is to provide an automated dadoing machine operable by relatively unskilled artisans.

A still further object of the present invention is to provide an automated dadoing machine capable of cutting material of an unlimited length.

These and other objects of the present invention will become apparent to those skilled in the art as the description thereof proceeds.

The present invention will be described with greater specificity and clarity with reference to the following drawings, in which.

Figure 10:
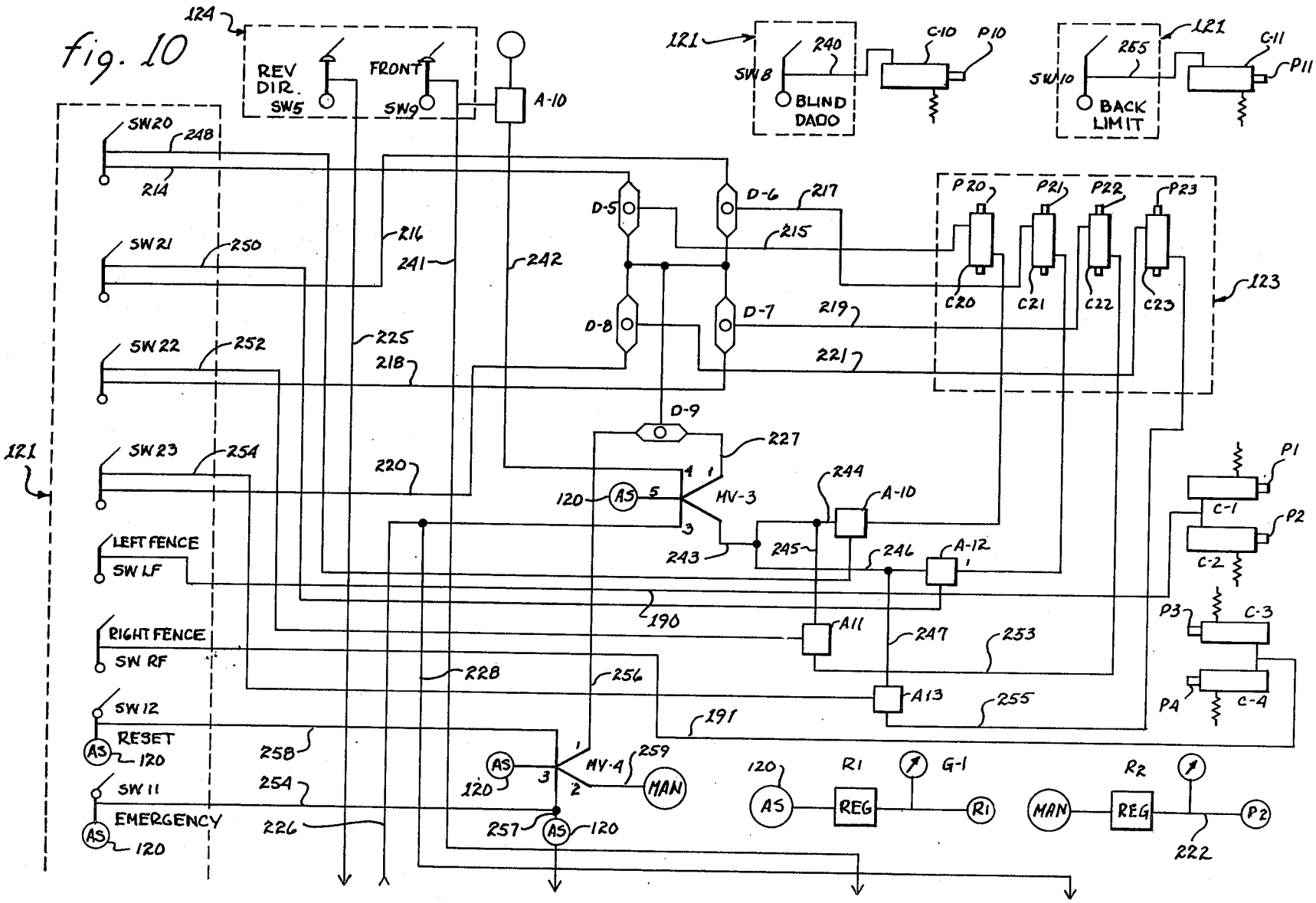
Figure 11:
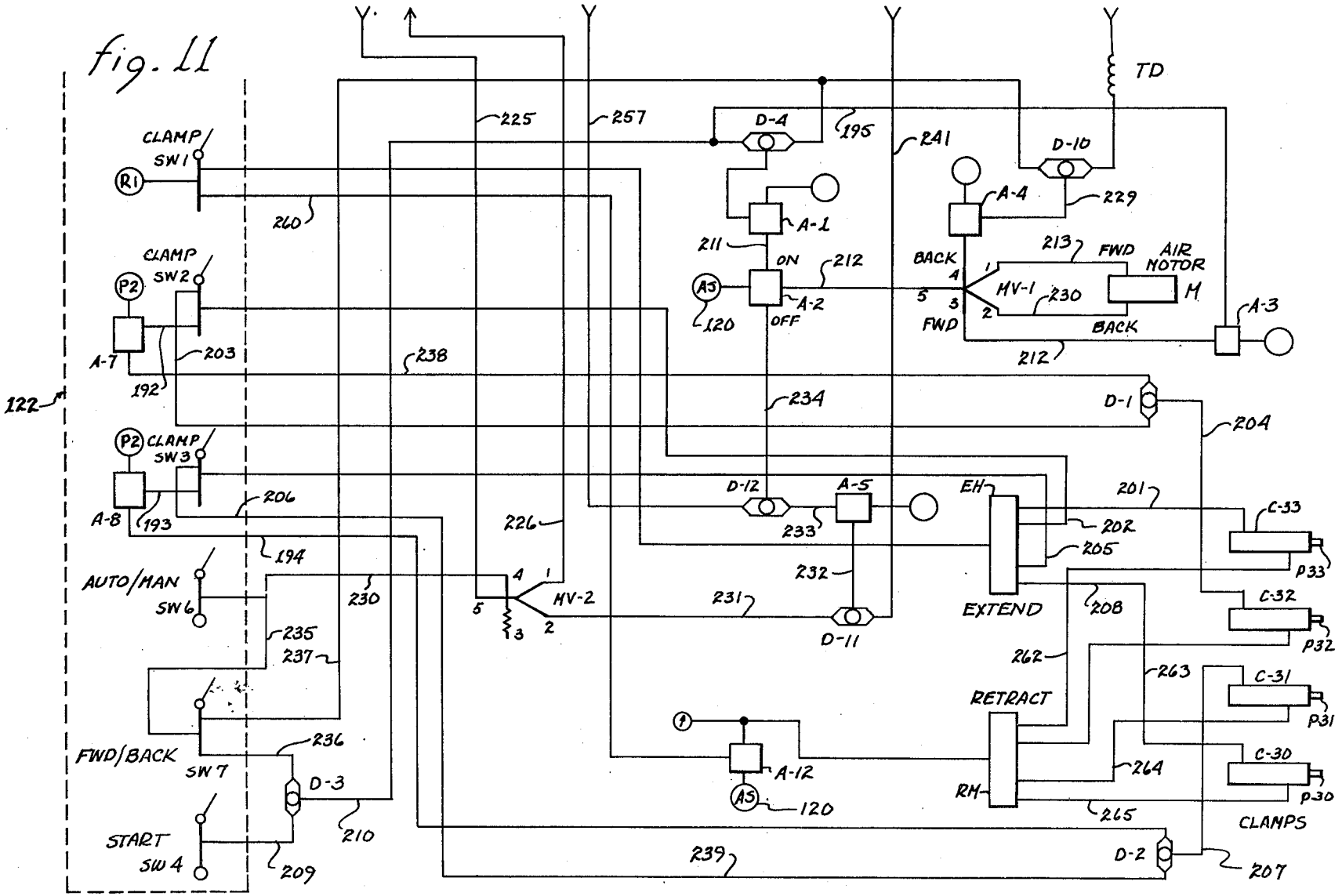

FIGS. 9*a* to 9*k* illustrate the symbology used in FIGS. 10 and 11.

Figure 8:
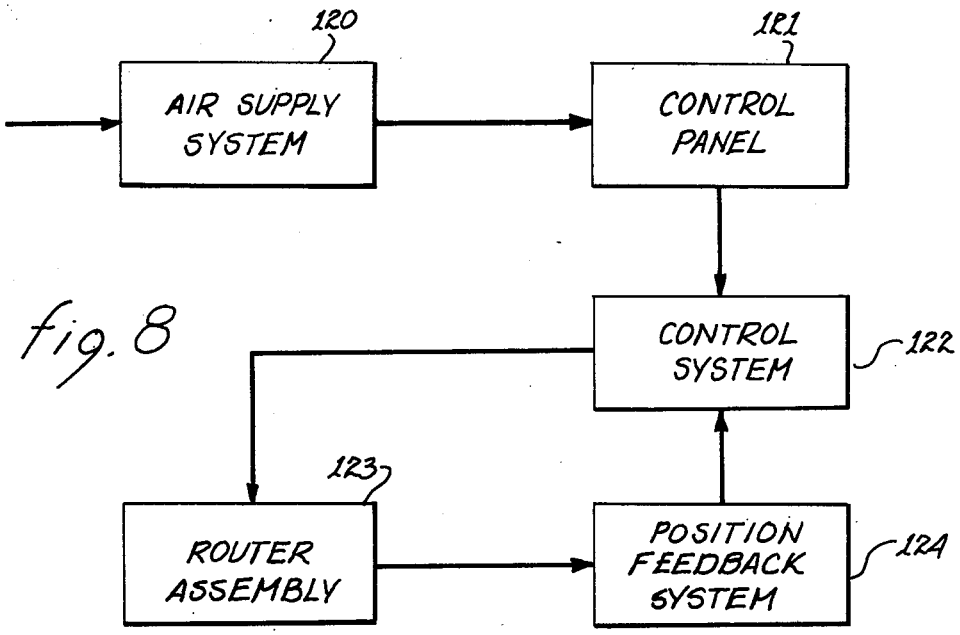
FIG. 8 is a block diagram of the pneumatic system incorporated in the present invention.
Figure 9:
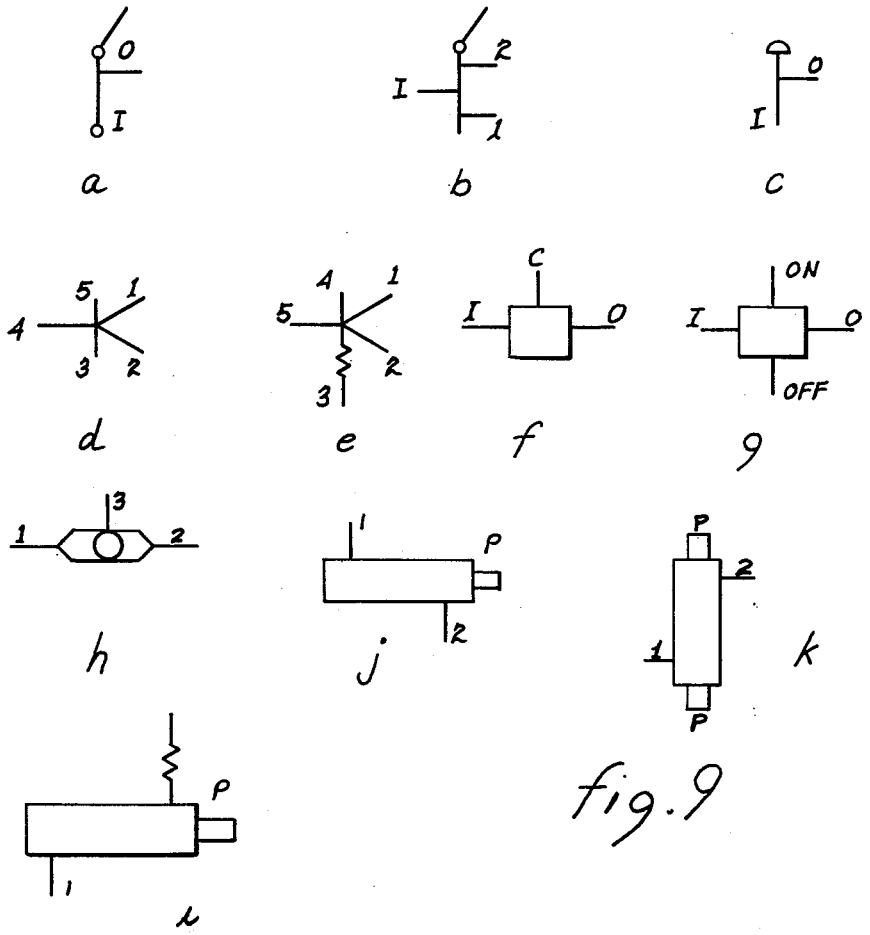

FIGS. 10 and 11, taken together, are schematics of the various elements shown in the block diagram of FIG. 8.

Figure 1:
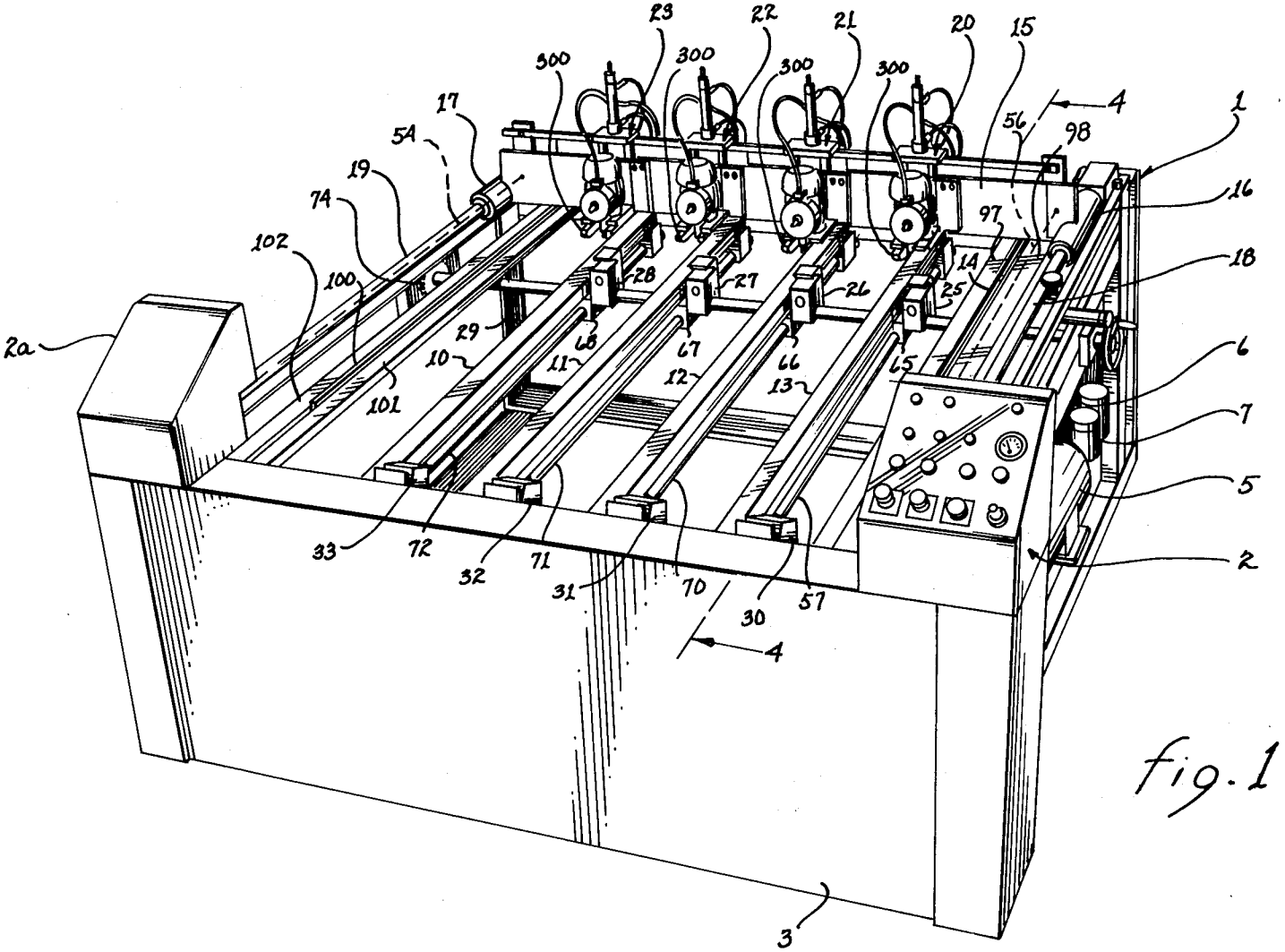
FIG. 1 illustrates a perspective view of the present invention.

FIG. 1 illustrates the relative arrangement of the components of the automatic dadoing machine of the present invention. A plurality of robust material supporting rails 10, 11, 12 and 13 extend across frame 1 of the machine and support the material being worked upon. Side fences 14, 100 when raised serve as lateral guides for the material. A carriage 15 extends transversely across the rails and is displaced upwardly therefrom. The carriage is movably supported with respect to frame 1 by guides 16 and 17 engaging rods 18 and 19, respectively, which rods accommodate movement of the carriage along the longitudinal axis of rails 10, 11, 12 and 13. A plurality of router assemblies 20, 21, 22 and 23 are positionable along and attachable to carriage 15. A rear set of clamps 25, 26, 27 and 28 are mounted upon a rod 29, which clamps are engageable with the rear edge of the material to be dadoed. A front set of clamps 30, 31, 32 and 33 are pivotable to retain the opposite edge of the material and force the sheet of material to be worked upon against the rear set of clamps. A plurality of controls and gauges are mounted in a control panel 2. These controls regulate the operation of the dadoing machine and include means for pre-programming the operation of the machine within predeterminable parameters. A second or auxiliary control panel 2a may be used.

Before proceeding with a detailed description of the components of the present invention, it may be well to provide a brief overview of its operation. After a sheet of material has been placed upon rails 10-13 and against one of side fences 14 or 100, it is pushed into engagement with the rear set of clamps. The front set of clamps are actuated to maintain the material in engagement with the rear set of clamps and the raised side fence. If not already so done, the router assemblies 20-23 are positioned along carriage 15 at positions corresponding to the dados to be cut with reference to either of the side fences. Appropriate controls are selected to determine whether the dados should be cut clear across the sheet of material or to some lesser depth. The desired router assemblies are energized and lowered to a predetermined depth. On actuation of a start control, further mechanisms are pneumatically energized to transport carriage 15 across the sheet of material and automatically return it. During the forward sweep of carriage 15, selected ones of the router assembly routers engage the sheet of material and cut the dados. During the return sweep, the router assemblies are raised out of engagement with the sheet of material. On return of carriage 15 to the start position, the same routers drop into position behind the sheet of material ready for the next cutting pass and the front set of clamps are releasable and the sheet of material may be removed.

Figure 2:
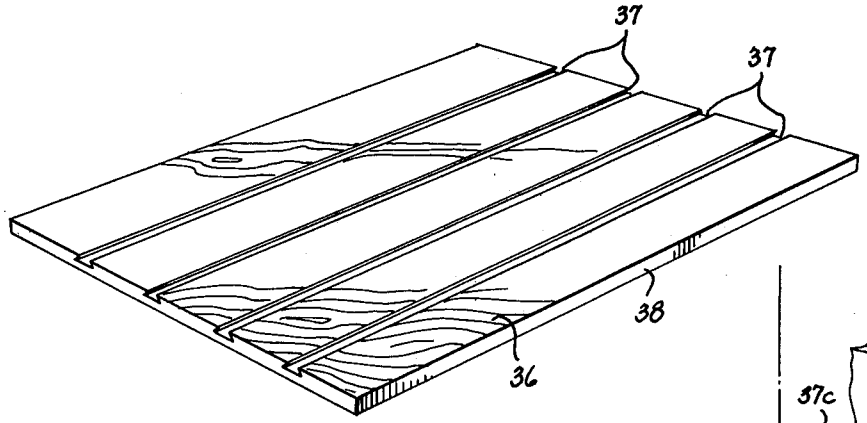
FIG. 2 illustrates a sheet of material worked upon by the present invention.

FIG. 2 illustrates a sheet of material 36 having a plurality of dados 37 formed therein by the present invention. These dados may be standard 90° dados or of an interlocking dovetail configuration. The material may be wood, wood composition, a combination of wood and synthetic material or, in fact, any material which can be worked upon by a dado router.

Figure 3:
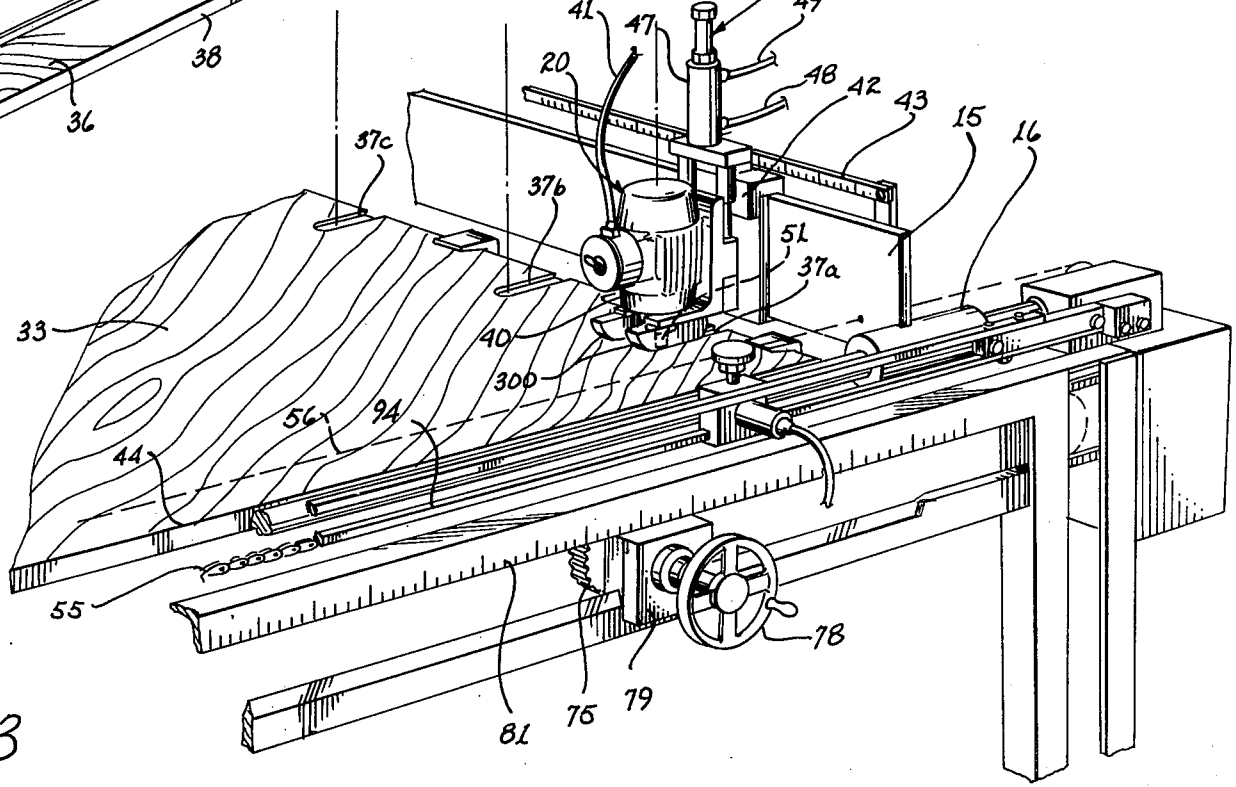
FIG. 3 illustrates a partial view of adjustment mechanisms embodied in the present invention.

Additional details of the router assemblies and the router carriage actuating mechanisms will be described with reference to FIG. 3. Router assembly 20 includes an electric motor 40 receiving electrical power through conduit 41 from a 7.5 KVA frequency converter 5 to rotate the motor at approximately 21,000 rpm. Motor 40 is mounted to a bracket 42, which bracket, by mesne means is selectively positionable along carriage 15. A scale 43 extends along carriage 15. An index upon bracket 42 cooperates with the scale to enable the positioning of router assembly 20 at a predeterminable distance from side fence 14 or 100 (see FIG. 1). Thereby, the displacement of dado 37a from edge 38 of material 36 is readily and accurately predeterminable. Similarly, the displacement of dados 37b and 37c from edge 38 are determinable.

The vertical movement of router motor 40 is regulated by a pneumatic cylinder/plunger assembly 47 which receives and discharges air through holes 48 and 49. The plunger of assembly 47 is pneumatically extendable upwardly and downwardly with respect to carriage 15. The downwardly extending end of the plunger is attached via a clevis to the electric motor mount to raise and lower the electric motor with respect to the carriage. The upward displacement of the extending end of the plunger is regulated by means of a bushing and nut assembly 50. Thereby, adjustment of the nut of the bushing and nut assembly regulates the vertical displacement of the plunger, and, hence, the lower limit to which the router and its presser feet can travel, adjustable for varying thicknesses of material. The depth to which the cutter or router 51 penetrates material 36 is determined by how far the cutter extends below the presser feet 300. In practice, a removable jig is generally employed to adjust and limit the downwardmost position of the router.

From the above discussion, it will become apparent that both the displacement of dado 37 from the edge of the material can be accurately regulated and the depth of the dado is similarly accurately controllable. The width and/or shape of the dado is necessarily controlled by the cross-section of the router bit.

The movement of carriage 15 is under the direction of and controlled by an air motor located behind panel 3 at the front of frame 1 (see FIG. 1). The output shaft of the motor is connected through a gear reduction box to a drive sprocket mounted upon a shaft. Further sprockets are mounted at each end of the shaft in approximately general vertical alignment with guides 16 and 17 and their respective supporting rods 18 and 19. Continuous chains 54 and 55 (see FIGS. 3 and 6) extend rearwardly along the left and right sides of frame 1 from behind panel 3 to sprockets rotatably mounted in proximity to the rear edge of the frame. Chains 54 and 55 are supported by various drive and idler sprockets and are mechanically connected to each end of carriage 15. On actuation of the air motor, movement of both continuous chains will ensue. Necessarily, corresponding movement of carriage 15 and guides 16 and 17 will occur and cause translatory motion forwardly and/or rearwardly. By this arrangement, a force is simultaneously applied to both ends of carriage 15 to prevent binding or dragging of either end. Moreover, as the guides are supported upon rods 18 and 19 by means of low friction bearings, lateral or sideways movement of carriage 15 is essentially prohibited, thereby ensuring straight cut dados.

The purpose and operation of material support rails 10, 11, 12 and 13 will be described with particular reference to FIGS. 1, 3, 4 and 7. The router assemblies, while working upon a sheet of material 37, exert a substantial downward pressure thereupon. To prevent flexing of the material and thereby vary the depth of the dado, material support rails 10, 11, 12 and 13 are each disposed beneath and in general vertical alignment with the router bits (i.e. router 51) of each router assembly 20, 21, 22 and 23. Each rail, supported only at its ends, must be relatively robust to prevent downward deflection of the supported sheet of material 37; hence, each rail is formed as an extruded length of square tubing of substantial thickness.

The ends of each rail rest upon horizontal inwardly directed lips or flanges 82, 83 located within the front and rear sides, respectively, of frame 1. To maintain the rails parallel to one another and to prevent racking, a shaft, such as shaft 57, is located beneath and parallel to each rail and attached thereto by means of bearing blocks 58 and 59 extending downwardly from the rail. Pinion gears 60 and 61 are non-rotatably attached to the ends of shaft 57 and engage downwardly directed racks 62 and 63 attached to the lower surface of flanges 82 and 83, respectively.

After a router assembly, such as router assembly 20, has been positioned along carriage 15, rail 13 is manually moved left or right until it becomes lodged in general vertical alignment with router 51. Thereby, the downward force exerted by router 51 upon the sheet of material to be dadoed is resisted by the underlying rail and prevents downward bending of the material at the point of the cut being made. The meshing of pinion gears 60 and 61 with their respective racks, ensures that rail 13 remains parallel to and aligned with the forward and rearward movement of router assembly 20.

Rear clamps 25, 26, 27 and 28 are attached to bearing blocks 65, 66, 67 and 68, respectively. These bearing blocks slidably engage shafts 57, 70, 71 and 72, respectively. A rod 29 penetrates and is rotatably mounted within each of clamps 25, 26, 27 and 28 and also extends through bearing blocks 65, 66, 67 and 68. Pinion gears 74 and 75 are non-rotatably mounted in proximity to the extremities of shaft 29. Pinion gear 74 engages a downwardly diirected rack 87 secured to the lower surface of an inwardly directed flange on the left side of frame 1 (see FIG. 6). Pinion gear 75 engages a downwardly directed rack 76 (see FIG. 5) attached to the lower surface of a flange 77 forming a part of the right hand side of frame 1. A hand wheel 78 is attached to the right hand extremity of shaft 79 to permit manual rotation of the shaft. An index block 79 engages shaft 29 and riders upon an upwardly directed flange 80 forming a part of frame 1. Index block 79 includes indicia related to scale 81.

The position of the rear set of clamps 25, 26, 27 and 28 is determined by the width of the sheet of material to be cut. Fore and aft positioning of the rear set of clamps is accomplished by means of hand wheel 78. By rotating the hand wheel in the clockwise or counterclockwise direction, the pinion gears mounted upon shaft 29 will translate along their respective racks to transport the set of clamps forwardly or rearwardly. Usually, the setting can be determined by means of scale 81 and the index upon index block 79.

It may be noted that lateral movement of rails 10, 11, 12 and 13 produce a corresponding movement of the respective adjacent clamp without in any manner affecting the fore and aft position of the set of clamps. Moreover, by maintaining the clamps essentially adjacent to their respective rails, the downward force exerted by the clamp foot upon the sheet of material is essentially resisted by the adjacent rail. Hence, a firm grip upon the sheet of material in proximity to the dado to be cut is established.

Figure 4:
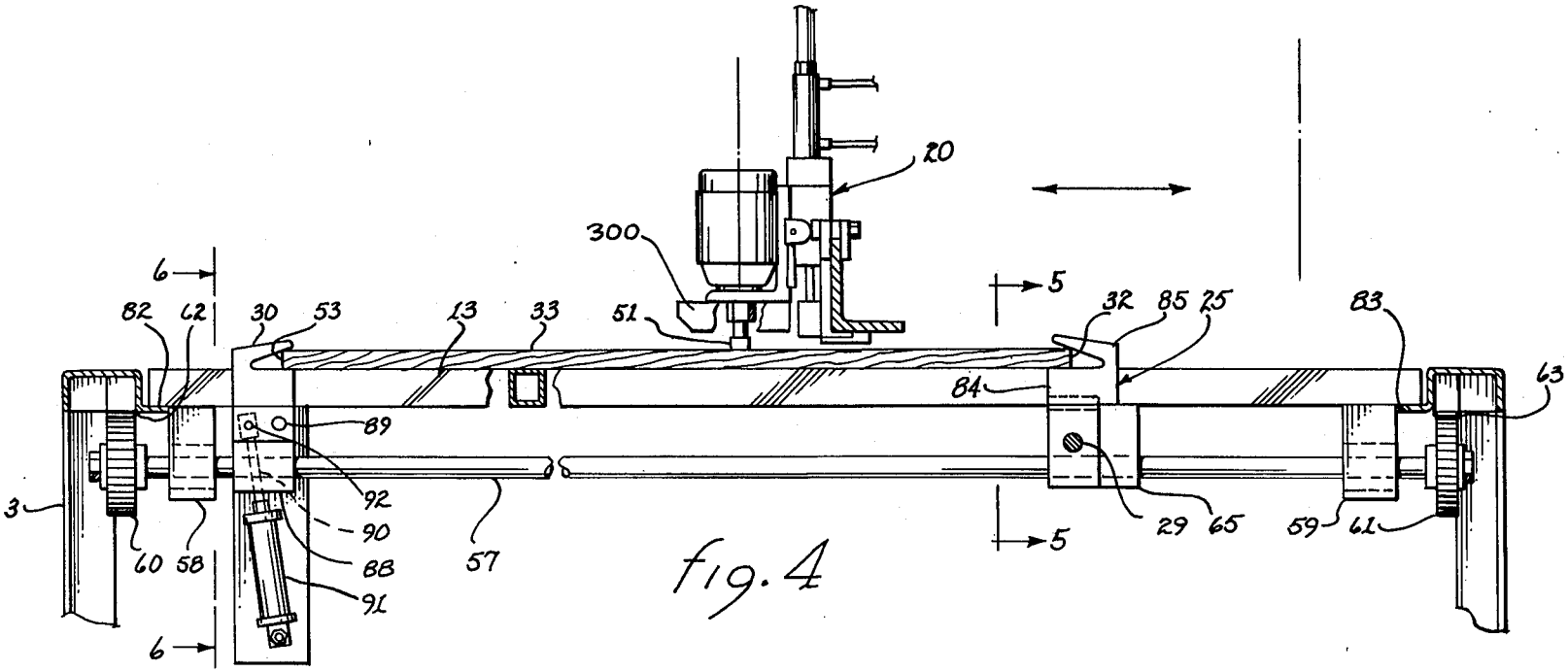
FIG. 4 is an elevational view of the present invention, taken along lines 4—4, as shown in FIG. 1.
Figure 5:
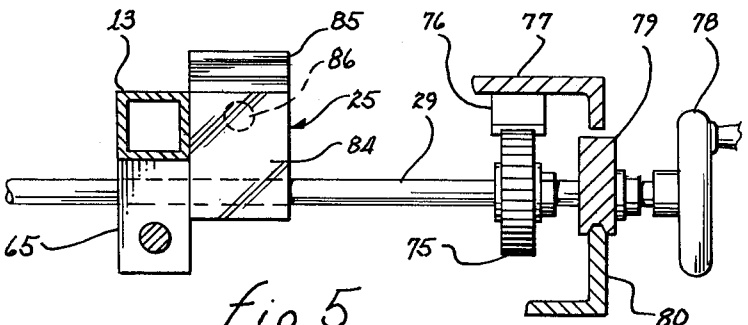
FIG. 5 is an elevational view of the clamp mechanism, taken along lines 5—5, as shown in FIG. 4.

As specifically illustrated in FIGS. 4 and 5, clamps 25, 26, 27 and 28 are formed of a block 84 and a foot 85 attached thereto by a spring loaded mechanism 86. The compliancy afforded by the foot compensates for any irregularities along edge 39 of sheet of material 37 such that the material can be placed against side fence 14 while each clamp still can perform a clamping function despite the irregularities along the edge.

Figure 6:
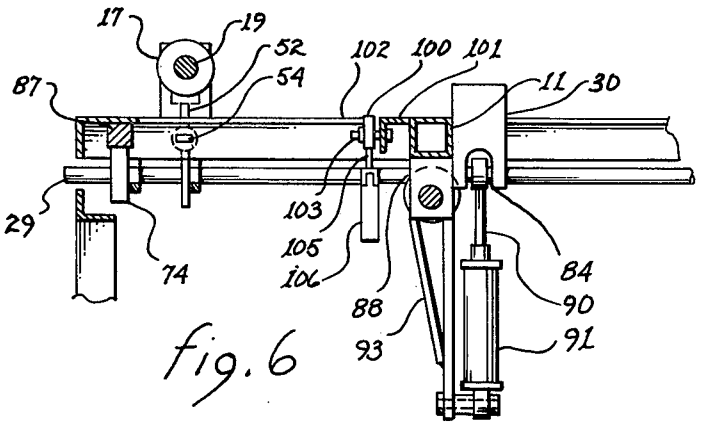
FIG. 6 is an elevational view, taken along lines 6—6, as shown in FIG. 4.

The front set of clamps 30, 31, 32 and 33, will be described with particular reference to FIGS. 1, 4, 6 and 7. For illustrative purposes, a side view of clamp 30 is illustrated in FIG. 4 and a rear view of clamp 33 is illustrated in FIG. 6; for simplicity, the elements common to both clamps will be identified with like numerals. A bearing block 88 is attached to the undersurface of the respective rail to rotatably engage the respective shaft. Each clamp is pivotally attached at the side of the bearing block by a pivot shaft 89. Plunger 90 of a pneumatically operated cylinder 91 is pivotally attached to a clamp by a pivot shaft 92 forwardly of pivot shaft 89. The base of cylinder 91 is attached to the lower extremity of a bracket 93 extending downwardly from bearing block 88.

In the position illustrated, the clamp engages edge 53 of material 37 to exert a downward force thereupon and maintain contact between the material and the adjacent rail; the clamp also forces the material rearwardly toward the rear set of clamps.

To disengage clamps 30, 31, 32 and 33, from the sheet of material, respective plungers 90 are pneumatically retracted to produce a pivotal movement of each of the clamps about pivot shafts 89, which movement is toward the front of the machine and downwardly. This movement continues until the clamps are disposed beneath a plane defined by the upper surfaces of the rails. It may be appreciated that as each of the clamps and their respective actuating mechanisms are attached to one of the rails, lateral repositioning of the rails will bring about a commensurate lateral displacement of the respective clamps such that each clamp is continually maintained adjacent its respective rail.

Figure 7:
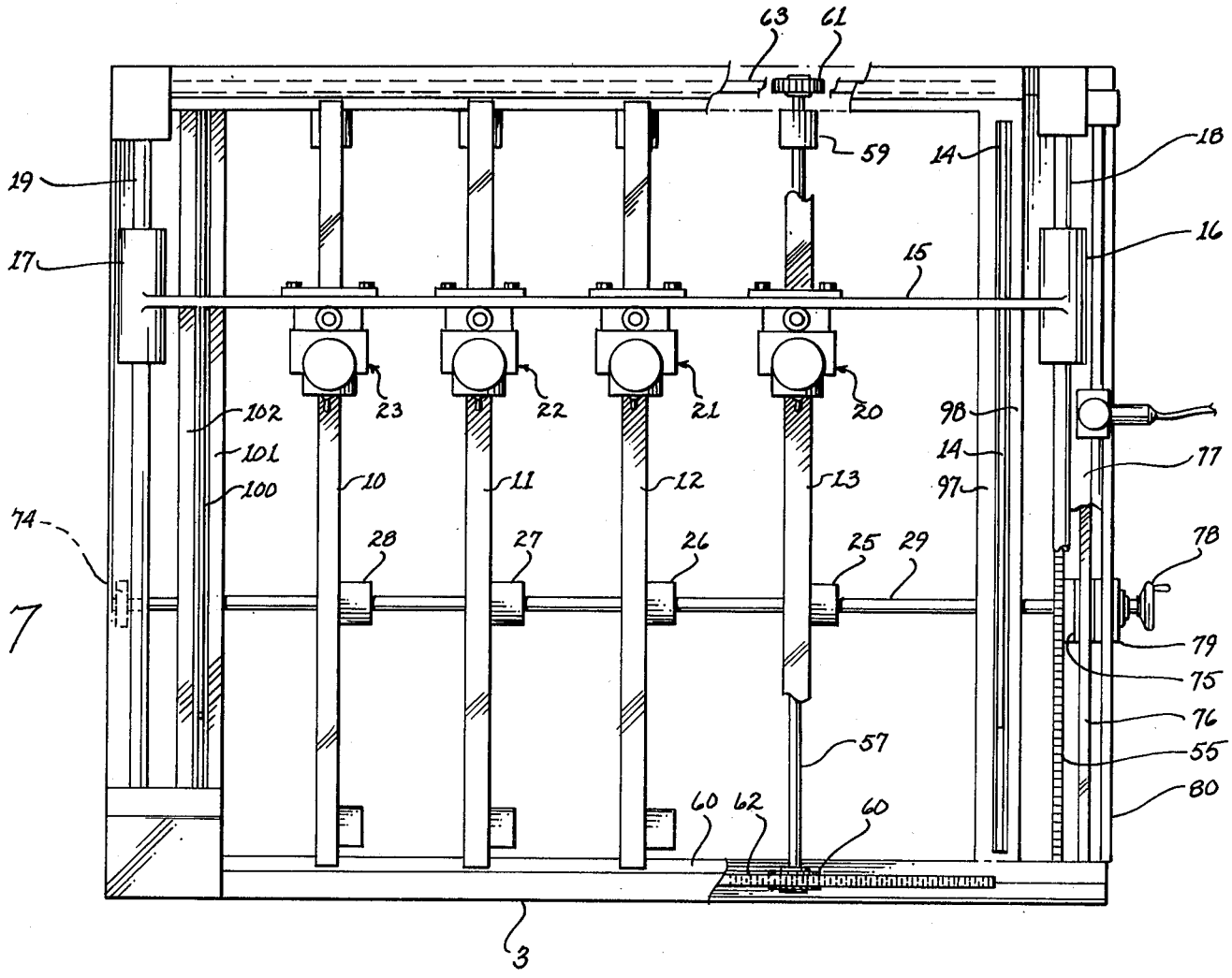
FIG. 7 is a top view of the present invention.

Referring jointly to FIGS. 1, 6 and 7, the side fences 14 and 100 for positioning a sheet of material will be described. On the right hand side of frame 1, a retractable fence 14 is disposed intermediate a material supporting angle iron 97 and a material supporting surface 98. Similarly, on the left hand side of frame 1, a retractable fence 100 is disposed intermediate a material supporting angle iron 101 and a material supporting surface 102. A plurality of bolts 103 extend intermediate the downwardly extending flange of angle iron 101 and a brace extending downwardly from surface 102. A plurality of upwardly extending cutouts within fence 100 receivingly accommodate bolts 103. Plunger 105 of a pneumatically operated cylinder 106 is attached to fence 100. Thereby, on extension of plunger 105, fence 100 is raised and on retraction of the plunger, the fence is lowered. It is to be understood that fence 14 on the right hand side of frame 1 is similarly constructed and operates in like manner.

An actuating bar, such as bar 94, is slidably mounted along the upper right hand side of frame 1. It supports a selectively positionable pneumatic cylinder/plunger assembly 95. Assembly 95, when the plunger is extended, interferes with rearward movement of carriage 15 and produces incremental rearward movement of bar 95. A mechanically operated pneumatic switch (not shown) responds to movement of the bar and generates a control signal, as will be described in further detail below.

A mechanically operated pneumatic switch is mounted within frame 1 to sense when carriage 15 has reached its forwardmost permissible position. It generates a control signal to bring about rearward movement of the carriage.

In describing the pneumatic control system of the present invention, reference will be made primarily to FIGS. 8, 10 and 11 supported by the following legend of elements shown in FIGS. *9a* through *9k*. Repetition of the operation of the elements in FIGS. *9a* through *9k* will not be made unless the requirement for clarity so demands.

FIG. *9a* represents a single output pneumatic manual toggle switch. The air flow from input I through output O is determined by the position of the manual switch. In the position shown, the air flow from input I through output O is inhibited. When switched, the switch is open and the air flow into input I will flow through output O.

FIG. *9b* represents a dual output manual toggle switch. An input airflow on input I will be channeled to either output 1 or output 2. In the switch position shown, the airflow into input I is channeled through output 1. When switched, the air flow into input I is channeled through output 2.

FIG. *9c* represents a single output pneumatic mechanically actuated push button switch. The air flow from input I through output O is determined by the position of the button. Unless the button is depressed, the air flow from input I through output O is inhibited.

FIG. *9d* represents a pneumatic flip flop. An input on line 5 will be channeled into either output 1 or output 2. A signal on one of the pilot vents, represented by numerals 3 and 4, directs the input through either output 1 or output 2, respectively. After the input has been channeled through one of the outputs, the input will continue to flow therethrough until a signal is present at the pilot vent corresponding to the other output.

FIG. *9e* represents a pneumatic flip flop having a spring return associated with pilot vent 3. An input on line 5 will be channeled to either output 1 or output 2. A signal on pilot vent 4 will direct the input to output 2. Upon cessation of the signal on pilot vent 4, the spring return of pilot vent 3 is released and the input will be switched through output 1.

FIG. *9f* represents an actuator. An air pressure present on pilot vent C opens the actuator to accommodate an air flow from input I through output O. On cessation of an air pressure on pilot vent C, the output air flow is blocked.

FIG. *9g* represents an actuator. An air pressure present on pilot vent ON opens the actuator to accommodate an air flow from input I through output O. An air pressure present on pilot vent OFF closes the actuator to inhibit an air flow from input I through output O.

FIG. *9h* represents a directional valve. The input on either input 1 or input 2 will be directed through output 3. There is no air flow from input 1 to input 2 or vice versa.

FIG. *9a* represents a spring return air actuated cylinder having a plunger *p*. An air pressure present on input 1 will extend plunger *p*. In the absence of an air pressure on input 1, plunger *p* will retract.

FIG. *9j* represents an air actuated cylinder having a plunger p. An air pressure present on input 1 will extend the plunger, while an air pressure on input 2 will retract the plunger.

FIG. *9k* represents an air actuated cylinder having a dual output plunger *p*. An air pressure present on input 1 will extend plunger *p* upwardly, while an air pressure on input 2 will extend plunger *p* downwardly.

Referring momentarily to FIG. 8, there is illustrated a basic schematic of the control and regulatory system of the present invention. An air supply system 120 includes a compressor, a pressure tank, a manifold, air filter systems and pressure regulators. It supplies an input of pressurized air to control panel 121. The control panel (panel 2 in FIG. 1) includes a plurality of switches, gauges and push buttons, which regulate and control the operation of the present invention. The output signals of the control panel are conveyed to control system 122. The control system includes the various valves, actuators and pneumatically actuated plungers. The router assembly related output signals from the control system are conveyed to router assembly 123. The movement of the router assemblies provides inputs to a position feedback system 124. The position feedback system generates control signals responsive to the position of the router assemblies and transmits such control signals to control system 122; therein, the position feedback system generated control signals modify the control system output signals.

FIGS. 10 and 11, jointly, illustrate a schematic of the pneumatic system incorporated within the present invention. In order to simplify an understanding of the pneumatic system, the numerals employed in FIG. 8 have been appended to dashed line blocked areas within the schematic to illustrate correlation between the block diagram and the schematic.

Prior to energization of the automatic dadoing machine, an external air source must be connected to the two filter-regulator-lubricator assemblies at the rear of the machine. The air is filtered and lubricated before entering the machine, such as by filters 6 and lubricator 7 (see FIG. 1).

This air supply feeds at all inputs designated AS. Furthermore, all inputs to valves, switches and actuators which inputs are connected to a common manifold are designated by a small circle.

Prior to operation of the automatic dadoing machine, the router assemblies 20, 21, 22 and 23 are positioned and clamped down at locations corresponding to the to-be-formed dados. As mentioned above, the router assemblies may be referenced to either right fence 14 or left fence 100. Rails 10, 11, 12, 13 are repositioned into alignment with their respective router assemblies. The rear clamps 25, 26, 27 and 28 are adjusted by hand wheel 78 to positionally correspond with the width of the material to be dadoed.

Depending upon which fence is to be raised, either the left fence switch SWLF or the right fence switch SWRF on the control panel 2 is actuated. Actuation of either of these switches will convey a source of air pressure from the manifold to the input of cylinders C1 and C2 or cylinders C3 and C4 via lines 190, 191, respectively. Actuation of these cylinders will cause plungers P1 and P2 or plungers P3 and P4 to extend and raise the left fence 100 or right fence 14, respectively. The sheet of material 37 may now be placed upon rails 10, 11, 12 and 13 against rear clamps 25, 26, 27 or 28 and against the raised fence. To secure the sheet of material, the clamp switches switch SW1, SW2 and SW3 are actuated. The input to switch SW1 is obrained from air supply AS and pressure regulated by regulator R1 to a pressure of approximately 160 psi. This high pressure input to switch SW1 is indicated by symbol R1. A gauge G1 is mounted upon control panel 2 to provide a visual indication of the actual pressure to switch SW1. A source of low air pressure of approximately 20 psi is provided by regulator R2 connected to air supply AS. The low air pressure source in indicated by symbol R2.

On energization of switch SW1, a high pressure input is provided to manifold EM through line 200. Output line 201 from manifold EM provides an input to cylinder C33 to cause plunger P33 to extend and raise clamp 33. Output line 202 from manifold EM conveys a source of air under high pressure to the input of clamp switch SW2. In the position shown, the high pressure input will flow from switch SW2 through line 203 to one input of directional valve D1. The output of valve D1 will flow through line 204 to the input of cylinder C32 to extend plunger P32 and raise clamp 32. Output line 205 of manifold EM will convey a source of air pressure to the input of clamp switch SW3. In the position shown, the output of switch SW3 will flow through line 206 to directional valve D2. The output of valve D2 will flow through line 207 to the input of cylinder C31 to extend plunger P31 and raise clamp 31. Output line 208 of manifold EM will convey a source of air pressure to the input of cylinder C30 to extend plunger P30 and raise clamp 30. At this point, the sheet of material is securely mounted upon the rails of the automatic dado machine.

Where the sheet of material is thin or otherwise readily bendable, it is prudent to provide a clamping force for clamps 31 and 32 which is of an insufficient magnitude to cause bending or flexing of the retained material. To provide such an option, switch SW2 is switched to its second position. The input to switch SW2 is applied to actuator A7 via line 192. On actuation of actuator A7 air at reduced pressure will flow from regulator R2 via line 238 to one input of directional valve D1. The output of directional valve D1, for reasons discussed above, will extend clamp 32 but the clamp will apply a relatively low retaining force upon the sheet of material. Similarly, switch SW3, when in a second position, will actuate actuator A8 via line 193 to provide a low pressure input to directional valve D2 via line 194. The output from directional valve D2 will actuate clamp 31 with a relatively low force to prevent bending of the retained sheet of material.

Generally, prior to actuation of start switch SW4, selected ones of router assemblies 20, 21, 22 and 23 are lowered. On actuation of switch SW20, a flow of air from the manifold will enter line 214 and be conveyed to an input of directional valve D5. The output of valve D5 is conveyed through line 215 to cylinder C20 to extend plunger P20 downwardly. Actuation of switch SW21 will convey an air flow from the manifold through line 216 to an input of directional valve D6. The output of valve D6 is conveyed through line 217 to cylinder C21 to extend plunger P21 downwardly. Actuation of switch SW22 will convey a flow of air from the manifold through line 218 to directional valve D7. The output of valve D7 is conveyed through line 219 to cylinder C22 to extend plunger P22 downwardly. Actuation of switch SW23 will convey a flow of air from the manifold through line 220 to directional valve D8. The output of valve D8 is conveyed through line 221 to cylinder C23 to extend plunger P23 downwardly. Thereby, selected ones of the router assemblies 20, 21, 22 and 23 have been extended downwardly to engage and cut dados in the sheet of material.

To start the dado cutting operation, the start switch SW4 is actuated. Switch SW4 receives an air pressure input from the manifold, as indicated, and conveys a source of air pressure through line 209 to directional valve D3. The output of valve D3 is conveyed through line 210 to the input of directional valve D4. The output of valve D4 provides an input signal to actuator A1. An input signal to actuator A1 conveys a source of air pressure from the manifold to provide an input signal through line 211 to actuator A2. An input signal to input ON of actuator A2 permits a flow through the actuator from the air supply AS into line 212. Line 212 provides an air flow to input 5 of multiple valve MV1. Line 210 from directional valve D3, via line 195, also provides an input signal to actuator A3. An input signal at actuator A3 provides a signal from the manifold through line 212 to pilot input 3 of valve MV1 to direct the air input from line 212 output 1 and line 213. The flow of air through line 213 is directed into air motor M to energize the motor in a forward direction. It may be recalled that the air motor is connected by mesne sprockets and chains to the router assembly carriage 15. Thus, by actuating start switch SW4, the carriage has been caused to move toward the front of the machine.

As the carriage moves toward the front of the machine, it, either directly or by means of bar 95, will ultimately come into contact with reverse direction switch SW5. When actuated, switch SW5 raises the routers and reverses the direction of travel of carriage 15. On actuation of switch SW5, an air flow from the manifold is conveyed through line 225 to the input 5 of multiple valve MV2. The position of the automatic/-manual switch SW6, determines whether or not the carriage is transported back to the rear of the machine. When switch SW6 is in the automatic position, no input will be provided to pilot input 4 of valve MV2. Hence, the air flowing into input 5 of valve MV2 will be channeled through output 1 into line 226. Line 226 conveys a flow of air to pilot input 3 of multiple valve MV3. The presence of pilot input 3 of valve MV3 directs air from the air supply at input 5 and through output 1 into line 227. Line 227 conveys a flow of air to directional valve D9. The output of valve D9 is conveyed simultaneously to valves D5, D6, D7 and D8. The outputs of valves D5, D6, D7 and D8 will convey respective signals to cylinders C20, C21, C22 and C23 to raise respective plungers P20, P21, P22 and P23 and raise the respective router assemblies out of contact with the sheet of material.

Simultaneously, an air flow from line 226 will flow into line 228. The air flow through line 228 is conveyed through a time delay TD to the input of directional valve D10. The output of valve D10 flows through line 229 to actuator A4. Actuation of actuator A4 provides a flow of air from the manifold to pilot input 4 of valve MV1 to switch the output of the valve from output 1 to output 2. The air flow from output 2 is conveyed through line 230 to air motor M to reverse the direction of rotation of the motor. Reverse rotation of the air motor reverses the direction of rotation of the motor. Reverse rotation of the air motor reverses the direction of travel of carriage 15 and the latter will return to its initial start point at the rear of the automatic dadoing machine. Thereby, it may be appreciated that when switch SW6 is in the automatic mode, the carriage will travel forwardly while the routers engage the sheet material and cut the dados. When the routers have completed their passage through the sheet of material, the router assemblies will be raised out the material and the carriage is returned to the start position. However, the time delay TD provides sufficient time to raise the router assemblies before the carriage returns to the start point.

When switch SW 6 is in the manual mode, a flow of air is conveyed from the manifold through line 230 to pilot input 4 of valve MV2 to switch the output of the valve through output line 2 into line 231. Line 231 conveys a flow of air to an input of directional valve D11.

The output of directional valve D11 is conveyed through line 232 to the pilot input of actuator A5. On actuation of actuator A5, air will flow from the manifold through the actuator into line 233 to an input of directional valve D12. The output from valve D12 will be conveyed through line 234 to pilot input OFF of actuator A2, closing the actuator and preventing further air flow through line 212. The lack of air flow output from valve MV1 cuts off the power to the air motor and it will stop, halting further movement of the carriage.

In the manual position of switch 6, air will also be conveyed through line 235 to the input of the forward-/back switch SW7. When switch SW7 is in the forward mode, air will flow therefrom through line 236 to valve D3 and provide an output into line 210. For reasons discussed above, an air flow through line 210 will provide an air source input to air motor M and energize the motor so as to move the carriage forwardly. When the forward/back switch SW7 is in the back position, air will flow through line 237 to an input of valve D4 and an input of valve D10. The output of valve D4 will actuate actuator A1 and provide a signal to pilot input ON at actuator A2 to permit a flow of air from the air supply to air motor M. The output from valve D10 will cause rotation of the air motor to return the carriage to the back/rear position, as described above.

In some cases, it is preferable to not have the dado extend across the whole sheet of material. To automatically accommodate such a limited length dado, a cylinder C10 is mounted within a movable actuating bar mounted along the right hand side of frame 1. On actuation of blind dado switch SW8, a source of air flow is conveyed from the manifold through line 240 to cylinder C10 to extend plunger P10. Plunger P10 extends into the forward path of carriage 15 and on contact therebetween, the attached actuating bar is forwardly repositioned. Forward repositioning of the actuator bar will cause it to contact and depress front mechanical switch SW9. When switch SW9 is depressed, air will flow from the manifold into line 241 to an input of valve D11. For reasons described earlier, the output of valve D11 will ultimately shut off the air flow to the air motor M and cause the carriage to stop its forward motion. An air pressure present within line 241 provides an input signal to actuator A10, via line 196, and permits a flow of air from the manifold through actuator A10 into line 242. The flow of air within line 242 provides a signal to pilot input 4 of valve MV3 to direct the output thereof through output 3 and into line 243. Line 243 interconnects with lines 244, 245, 246 and 247 to provide air pressure inputs to actuators A10, A11, A12 and A13, respectively. Actuation of switch SW20, provides an air pressure input to actuator A10 via line 248 to open the actuator and permit a flow of air to cylinder C20 through line 249 to raise plunger P20 and the associated router assembly. Actuation of switch SW20 provides an air pressure input to actuator A12 via line 250 to open it and provide an air flow to cylinder C21 via line 251 to raise plunger P21 and the associated router assembly. Actuation of switch SW22 provides an air pressure input to actuator A11 via line 252 to open it and provide an air flow to cylinder C22 via line 253 to raise plunger P22 and the associated router assembly. Actuation of switch SW23 provides an air pressure input to actuator A13 through line 254 to open it and provide air flow to cylinder C23 through line 255 and raise plunger P23 and the associated router assembly. The carriage is returnable to the start position by appropriate manipulation of switches SW6 and SW7.

Where a sheet of material is to be dadoed, which sheet is less than the full depth of the automatic dadoing machine, it is expedient to limit the rearward travel of the carriage to a point just behind the rear edge of the sheet of material. To do so, a back limit has been incorporated. A cylinder C11 is mounted within a movable actuating bar such that plunger P11 is extendable into the rearward path of the carriage. Energization of the back limit is effected through actuation of back limit switch SW10. On actuation of the switch, an air flow is conveyed from the manifold via line 255 to cylinder C11 to extend plunger P11. On contact by the carriage with plunger P11, the actuating bar will be repositioned, which repositioning depresses switch SW9. For reasons stated above, actuation of switch SW9 will shut off the motor transporting the carriage and simultaneously raise the routers.

As a safety precaution, an emergency switch SW11 is employed. On actuation of the emergency switch SW11, which switch may be a toggle switch or a push button switch, air will flow from the air supply through line 254 to pilot input 3 of valve MV4 and direct the flow of air from the air supply through input 5 into output 1. Line 256 conveys the flow of air from output 1 to an input of valve D9. For reasons described above, an air flow through the output of valve D9 will cause an immediate upward extension of plungers P20, P21, P22 and P23 with accompanying raising of the respective router assemblies. An air flow in line 254 will also provide an air flow through line 257 to an input of valve D12. The output of valve D12 is conveyed through line 234 to pilot input OFF of actuator A2. For reasons discussed above, actuator A2 will close and the air to air motor M will be shut off. It may also be noted that during the switching of the outputs of valve MV4, the air supply to the manifold was cut off. Hence, none of the switches or actuators depending upon the manifold for an air pressure source could be energized after actuation of the emergency switch.

To reset the present invention, reset switch SW12 is actuated. Switch SW12 will provide a flow of air from the air source through line 258 to pilot input 1 of valve MV1 and switch the output of the valve through output 2 into line 259. The air flow through line 259 reestablishes an air pressure within the manifold, which air pressure is employed by many of the above discussed switches, actuators and valves.

Once the dadoing operation has been completed, it is, of course, necessary to remove the sheet of material. To do so, clamp switches SW1, SW2 and SW3 are reactuated. Actuation of switch SW1 will provide air flow through line 260 to the pilot input of actuator A12. Upon opening of actuator A12, air will flow from the air supply through line 261 to the retract manifold MF. Line 262 interconnects manifold RM with cylinder C32 and causes retraction of plunger P32 and retraction of the respective clamp. Line 264 interconnects manifold RM with cylinder C31 and causes retraction of plunger P31 and the respective clamp. Line 265 interconnects manifold RM with cylinder C30 adn causes retraction of plunger P30 and retraction of the respective clamp. At this point, the sheet of material may be removed with or without lowering of the left and/or right fences by actuation of switches SWRF and/or SWLF.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A method for automatically cutting grooves in sheet material with routers having downwardly extending cutting bits, said method comprising the steps of:

a. supporting the sheet material upon a plurality of continuously parallel maintained rails;

b. locating each of the plurality of rails in vertical alignment with the bit of one of the routers to provide support beneath each bit for the sheet material;

c. gripping one edge of the sheet material with a plurality of first clamps mounted upon a common shaft and each first clamp being mounted adjacent and movable with each rail;

d. clamping another edge of the sheet material with a plurality of second clamps extending from and movable with each rail to maintain the sheet material adjacent the plurality of rails and biased toward the plurality of first clamps;

e. actuating the plurality of second clamps by a first plurality of input controls to secure the sheet material in place;

f. identifying the number and length of the grooves to be cut in the sheet material by a second plurality of input controls;

g. translating the bit of each router with first drive means along and vertically upwardly displaced from the underlying one of the plurality of rails;

h. positioning the bottom of the bit of each router at a predetermined distance into and out of the plane of the sheet material with second drive means;

i. generating feedback signals with detection means indicative of the location of the bits of the routers along the plurality of rails; and j. energizing the first and second drive means with control means responsive to the first and second plurality of input controls and the feedback signals generated by the detection means to form grooves in the sheet material through vertical positioning and horizontal translation of the bits of the routers.

2. The method as set forth in claim 1 including the step of limiting by reference to the upper surface of the sheet material the excursion of the bit of each of the routers into the sheet material.

3. A method for automatically cutting grooves in sheet material with routers having downwardly extending cutting bits, said method comprising the steps of:

a. supporting the sheet material upon a plurality of continuously parallel maintained rails;

b. locating each rail in vertical alignment with the bit of one of the routers;

c. clamping the sheet material adjacent the rails by a pair of opposed clamps pivotally secured to each rail and engaging opposed edges of the sheet material by exerting downward and opposed horizontal clamping forces upon the engaged edges;

d. actuating at least one clamp of each pair of clamps by a first plurality of input controls;

e. identifying the number and length of the grooves to be cut by a second plurality of input controls;

f. translating the bit of each router along and upwardly displaced from the underlying one of the plurality of rails;

g. positioning the bottom of the bit of each router at a predetermined distance into and out of the plane of the sheet material with second drive means;

h. generating feedback signals with detection means indicative of the location of the bits of the router along the plurality of rails; and i. energizing the first and second drive means with control means responsive to the first and second plurality of input controls and the feedback signals generated by the detection means to form grooves in the sheet material through vertical positioning and horizontal translation of the bits of the routers.

4. The method as set forth in claim 3 including the step of limiting by reference to the upper surface of the sheet material the excursion of the bit of each of the routers into the sheet material.

* * * * *